United States Patent [19]

Tsumaki et al.

[11] Patent Number: 4,812,774

[45] Date of Patent: Mar. 14, 1989

[54] ELECTRON BEAM STABILIZING METHOD FOR ELECTRON STORING RING, AND ELECTRON STORING RING SYSTEM

[75] Inventors: Koji Tsumaki, Hitachi; Kenji Miyata; Masatsugu Nishi, both of Katsuta, all of Japan

[73] Assignee: Hitachi, Ltd, Tokyo, Japan

[21] Appl. No.: 130,234

[22] PCT Filed: Feb. 23, 1987

[86] PCT No.: PCT/JP87/00115

§ 371 Date: Oct. 23, 1987

§ 102(e) Date: Oct. 23, 1987

[87] PCT Pub. No.: WO87/05461

PCT Pub. Date: Sep. 11, 1987

[30] Foreign Application Priority Data

Feb. 26, 1986 [JP] Japan ..... 61-39229

[51] Int. Cl.[4] ..... H05H 7/00

[52] U.S. Cl. ..... 328/233; 328/228

[58] Field of Search ..... 328/228, 233, 237

[56] References Cited

U.S. PATENT DOCUMENTS 2,882,396 4/1959 Courant et al. ..... 328/237

*Primary Examiner*—David K. Moore

*Assistant Examiner*—K. Wieder

*Attorney, Agent, or Firm*—Antonelli, Terry & Wands

[57] ABSTRACT

In an electron storage ring comprising: a bending magnet for bending an electron beam; a focusing magnet for focusing the electron beam; a radio-frequency accelerating cavity for accelerating electrons; and a vacuum chamber, a voltage component fluctuating with time, e.g., sinusoidally is superposed on the power source of the focusing magnet, in case the electron beam is to be accelerated, to fluctuate the intensity of the focusing magnet. As a result, the number of the betatron oscillation of electron can be changed each time the electrons pass through the focusing magnet so that the damping rate can become higher than the growth rate of the instability of the beam to suppress the instability of the electron beam.

5 Claims, 5 Drawing Sheets

(a) RELATION BETWEEN ACCELERATION RISE TIME AND INTENSITY OF MAGNETIC FIELD OF BENDING MAGNETS (b) RELATION BETWEEN ACCELERATION RISE TIME AND INTENSITY OF FOCUSING MAGNETS (a) RELATION BETWEEN ACCELERATION RISE TIME AND INTENSITY OF MAGNETIC FIELD OF BENDING MAGNETS (b) RELATION BETWEEN ACCELERATION RISE TIME AND INTENSITY OF FOCUSING MAGNETS (a) RELATION BETWEEN ACCELERATION RISE TIME AND SUPPLY VOLTAGE OF FOCUSING MAGNETS (b) RELATION BETWEEN ACCELERATION RISE TIME AND AUXILIARY SUPPLY VOLTAGE OF FOCUSING MAGNETS (c) RELATION BETWEEN ACCELERATION RISE TIME AND INTENSITY OF MAGNETIC FIELD OF FOCUSING MAGNETS (I: PRESENT METHOD
Io: OTHER METHODS)

ELECTRON BEAM STABILIZING METHOD FOR ELECTRON STORING RING, AND ELECTRON STORING RING SYSTEM

DESCRIPTION

1. Technical Field

The present invention relates to a method of suppressing instability to be caused when electrons are to be accelerated from a low energy by an electron storing ring and a system for the method.

2. Background Art

The prior art has the following three systems as a storage ring system for accelerating and storing an electron beam. These three systems are shown in FIG. 2. The first one is a system constructed of a linear accelerator and a storage ring. The electron beam is accelerated to a final energy by the linear accelerator and implanted into the storage ring, in which the electrons are exclusively stored but not accelerated. This system can have a large storage current value but is accompanied by a defect that the linear accelerator becomes excessively long. The second system is constructed of a linear accelerator, a synchrotron and a storage ring. In this system, the electron beam is accelerated to the velocity of light by the linear accelerator and implanted into the synchrotron, in which the electrons are accelerated to the final energy until they are implanted into and stored by the storage ring. This system is also enlarged and complicated as a whole. In the third system, the electron beam is accelerated to several hundreds MeV by the synchrotron and further accelerated in the storage ring. This system has a smaller size than the foregoing two systems, because the electron beam is accelerated to several hundreds MeV by the synchrotron of the linear accelerator, but is still rather large as a whole.

In order to reduce the whole size of a system, as in the third system, the acceleration energy of the pre-accelerator may be dropped to about 10 MeV, at which the electrons acquire the velocity of light, and the electrons may be accelerated to the final energy in the storage ring. The system is further reduced in size if the deflecting magnet in the storage ring is made superconductive. In this case, however, it is anticipated that the electrons are lost one after another in the course of acceleration so that the number of electrons to be finally stored becomes small.

For example, in case electrons are to be accelerated from a low energy of about 15 MeV to several hundreds MeV, the electron beam is sequentially attenuated while it is being accelerated, even if its initial current value at 15 MeV is near 1 A, so that the electricity to be left at the final energy is as high as several tens mA. Several causes for the electron beam to be lost are being considered, some being clarified but others being still unclarified. One cause conceivable for the electron beam loss is the electron beam instabilizing phenomenon due to the interaction between the electron beam and a radio-frequency cavity. This instabilizing phenomenon is the more serious for the lower electron energy. In order to raise the storage current value, therefore, it is a requisite that no instability be caused anyhow.

For the reasons described above, it has never been conducted to make an acceleration from a low energy by the storage ring. However, the closest example is the synchrotron.

In this synchrotron, the beam is accelerated within a short time period of several msecs to pass through a low-energy region, where the instability is liable to occur, so that its loss may be prevented as much as possible. If, however, a superconductive magnet is used as a deflecting magnet for deflecting the electron beam, about ten seconds is required for the acceleration rising time. As a result, the storage ring using the superconductive magnet will not allow the electron beam to pass within the short time through the low-energy energy region where the instability is liable to occur.

One method of raising the threshold current value, at which the instability will occur in the storage stage of high energy not in the case of the synchrotron acceleration, is to cause the Landau damping with an octupole magnet. However, this octupole magnet not only widens the range of resonance but also intrinsically establishes a nonlinear magnet field which unavoidably raises several problems. It is anticipated as a serious problem that the electron beam has its dynamic aperture narrowed to increase the electron loss in case it is accelerated from the low energy.

There is another method, in which the instability of the beam, if any, is detected so that it may be suppressed by a feedback control (See "Accelerator Science", pp 157 to 159 (1984)). In this case, however, there arises another problem that the circulation time of the beam is shortened, if the storage ring has a small size, to require a quick feedback system. There is accompanied a defect that the storage ring is complicated by providing the feedback system.

In order to accelerate a large current of about several hundreds mA, therefore, it is one target to increase anyhow the threshold current of instability of the electron beam of low energy.

SUMMARY OF INVENTION

An object of the present invention is to provide a method and a system for raising the threshold current value of the instability, which is caused when an electron beam is to be accelerated from a low energy by a storage ring, thereby to provide a small-sized simple storage ring system by making it possible to hold a large current even in the acceleration from the low energy.

In case electrons are introduced at a low energy of several tens MeV into the storage ring so that they may be accelerated to a high energy of several hundreds MeV, the magnetic field of a bending magnet for bending the electrons is intensified so that the energy is increased with the intensity of the magnetic field. At this time, the intensity of the magnetic field of a focusing magnet is also increased while its ratio being held constant to that of the bending magnet. In the prior art, as shown in FIG. 3, the intensity of the focusing magnet is increased with the same pattern as that of the bending magnet.

As shown in FIG. 1, the present invention is characterized in that the intensity of the focusing magnet is increased gradually or in the form of sinusoidal waves, for example, with time. The amplitude of the sinusoidal waves is made the smaller for the lower energy and the higher for the higher energy so that the ratio to the intensity of the focusing magnet may be substantially constant. The sinusoidally varying component may be made so independent that it may not be superposed on the focusing magnet.

Thus, the betatron frequency of electrons can be changed each time the electrons pass through the focusing magnet, by changing the intensity of the focusing magnet into the increasing pattern of the intensity of the magnetic field of the bending magnet to make it vary in the form of sinusoidal waves. As a result, even if an instability begins to occur at a certain instant, the betatron frequency has slightly changed when the electrons next circulate. Then, the growth rate of the instability becomes higher than that of attenuation so that the instability of the electron beam can be suppressed.

BEST MODE FOR CARRYING OUT THE INVENTION

Figure 2:
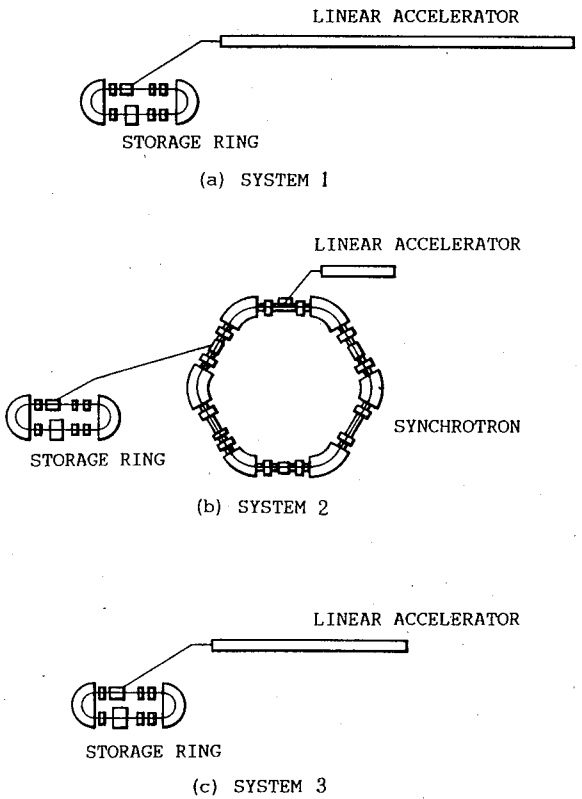
FIG. 2 is a diagram showing examples of the construction of the system.
Figure 1:
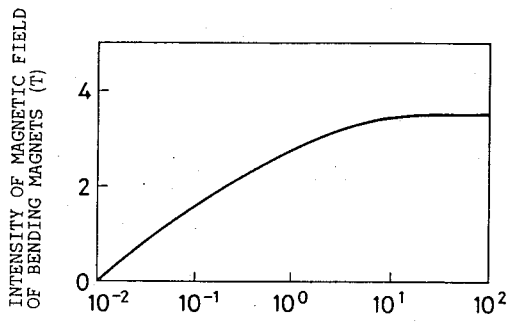
FIG. 1 presents graphs plotting the relationships between the acceleration rising time and the intensity of the magnetic field of the bending magnet and between the acceleration rising time and the intensity of the focusing magnet when the present stabilizing method is used.
Figure 1:
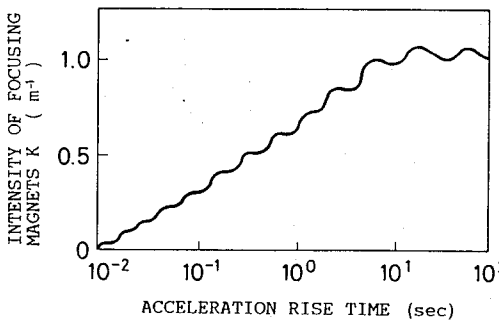
Figure 4:
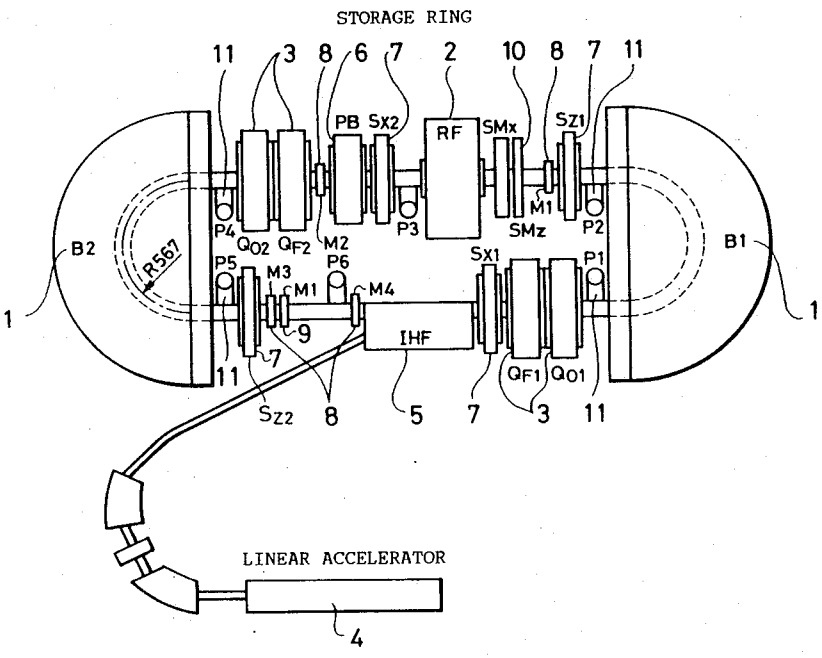
FIG. 4 is a diagram showing the construction of a storage ring and a linear accelerator.
Figure 3:
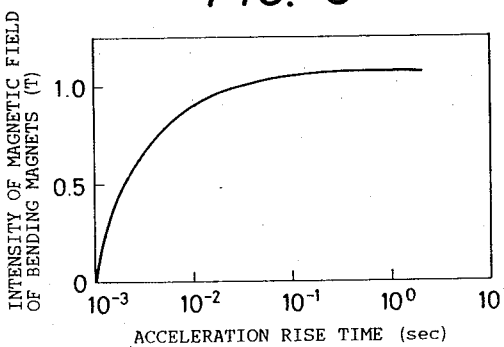
FIG. 3 presents graphs plotting the relationships between the acceleration rising time and the intensity of the magnetic field of the bending magnet and between the acceleration rising time and the intensity of the focusing magnet.
Figure 3:
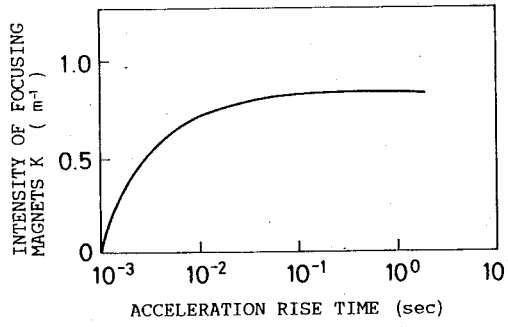

The embodiment of the present invention will be described in the following with reference to the accompanying drawings. As shown in FIG. 4, the present system is constructed of a linear accelerator for accelerating electrons to about 15 MeV, and a storage ring for accelerating the electrons once accelerated to about 15 MeV to several hundreds MeV and storing the electrons with an energy of several hundreds MeV.

The storage ring is composed, as shown in FIG. 4, of: bending magnets 1 (two, B1 and B2) for bending the electron beam; a radio-frequency accelerating cavity 2 (RF) for feeding the electrons with the energy; focusing magnets 3 (four, $Q_{F1}$, $Q_{O1}$, $Q_{F2}$ and $Q_{O2}$) for focusing the electrons; an inflector 5 (IHF) for deflecting the electrons from a linear accelerator 4 and introducing them into the storage ring; a perturbator 6 (PB) for distorting the electron orbit and facilitating the incidence; steering magnets 7 (two horizontal steering magnets $S_{X1}$ and $X_{X2}$ and two vertical steering magnets $S_{Z1}$ and $S_{Z2}$) for correcting the position of the electron beam; position monitors 8 (four, M1 to M4) for detecting the position of the electron beam; a current monitor 9 for monitoring a storage current value; sextupole magnets 10 (two, $SM_X$ and $SM_Z$) for correcting the chromatic aberration of the electron beam; and vacuum pumps 11 (six, P1 to P6) for evacuating the vacuum chamber of the storage ring to a high vacuum. The major parameters of the storage ring are tabulated in Table 1:

TABLE 1

| Major Ring Parameters | | |
|---|---|---|
| Items | | Value |
| Energy | E(MeV) | 500 |
| Intensity of Magnetic Field | B(T) | 4 |
| Radius of Curvature | $\rho$(m) | 0.42 |
| Number of Divisions | N | 2 |
| Length of Linear Section | l(m) | 3.4(2.2) |
| Operating Point | $K_F(m^{-1})$ | 1.40 |
| | $K_D(m^{-1})$ | −1.23 |
| Betatron Tune | $\nu_x$ | 1.58 |
| | $\nu_z$ | 0.53 |
| Momentum Compaction Factor | $\alpha_p$ | 0.205 |
| Circumferance | C(m) | 10.09 |
| Revolution Time | T(sec./rev) | $3.37 \times 10^{-8}$ |
| Chromaticity | $\xi_x$ | −0.71 |
| | $\xi_z$ | −0.84 |
| Energy Loss | $U_o$(kev/rev) | 13 |
| Energy Range | $\sigma_\epsilon = \frac{\delta E}{E}$ | $5.7 \times 10^{-4}$ |
| Radiation Damping Time | $\tau_x$(msec) | 6.47 |
| | $\tau_z$(msec) | 2.40 |
| | $\tau_\epsilon$(msec) | 0.91 |
| Emittance | $\epsilon_{to}(\pi \cdot mm \cdot mrad)$ | 0.55 |
| Harmonic Number | $\frac{f_{rf}}{fo}$ | 3 |
| Acceleration Voltage | $V_{rf}$(kev) | 100 |
| Acceleration Frequency | $f_{rf}$(MHz) | 89.1 |
| Synchronization Phase | $\phi_s$(deg) | 171 |
| Synchrotron Tune | $\nu_s$ | $4.20 \times 10^{-3}$ |
| Synchrotron Frequency | $f_s$(KHz) | 125 |
| Radio-Frequency Bucket | DE/E | $1.2 \times 10^{-2}$ |
| Beam Length | $\sigma_\epsilon$(mm) | 44.6 |
| Quantum Lifetime | $\tau_q$(min) | $6.0 \times 10^{67}$ |

Figure 5:
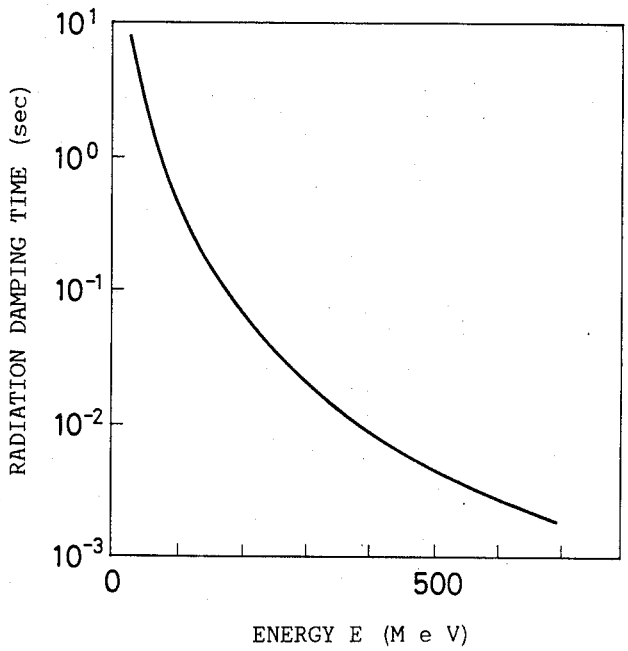
FIG. 5 presents a graph plotting the relationship between an energy and a radiation damping time.

Let it be assumed that the electrons are accelerated up to 15 MeV, for example, by the linear accelerator and introduced into the storage ring. The incident electrons continue to circulate while oscillating within the storage ring on a fixed orbit determined by the bending magnets. This central orbit is called the "closed orbit", and the oscillation on this closed orbit are called the "betatron oscillation". At this time, the electrons rotate in the form of several clusters. Each of these clusters is called a "bunch", and the number of clusters is called the "bunch number". The betatron oscillation can be further decomposed into vertical and horizontal ones. The electrons are further oscillating in their proceeding directions. These oscillations are called the "synchrontron oscillation". The electrons are accelerated within the bending magnets, while circulating within the storage ring, to emit a radiation in the tangential direction of the orbit. The acceleration cavity supplies the energy which has dropped as a result of the emission of the radiation. At this time, the momentum is supplied in the proceeding direction but not in the vertical direction. As a result, the betatron oscillation is finally attenuated to a certain constant beam size in accordance with the energy. The time for which those betatron oscillation emits the radiation to attenuate is called the "radiation damping time", for which the beam restores its initial state when perturbations are applied to the beam. Hence, the radiation damping can be said a stabilizing action owned by the beam itself. FIG. 5 plots the radiation damping time of the storage ring tabulated in the Table 1 and shown in FIG. 4. As seen from FIG. 5, the damping time becomes the longer for the lower energy, for example, $3\times10^{-3}$ secs for 500 MeV but 0.4 secs for 100 MeV and 120 secs for 15 MeV. It therefore can be said that the damping effect by the beam itself is signals for the lower energy. In the case of the acceleration from the lower energy, the state is accordingly shifted immediately after the incidence to increase the intensity of the bending magnets.

Figure 6:
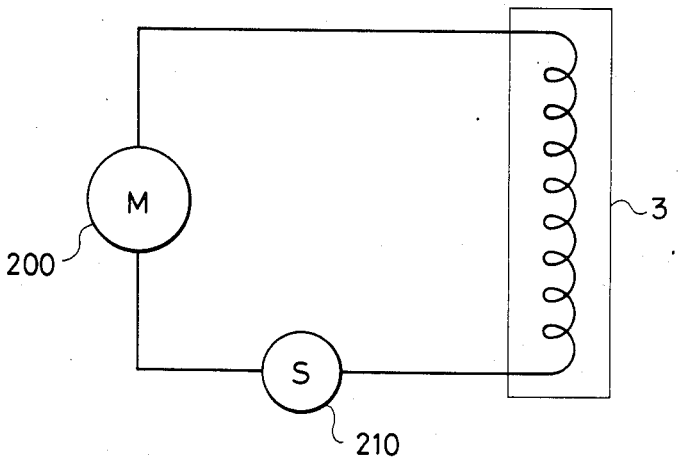
FIG. 6 is a diagram schematically showing the power source of the focusing magnet.
Figure 7:
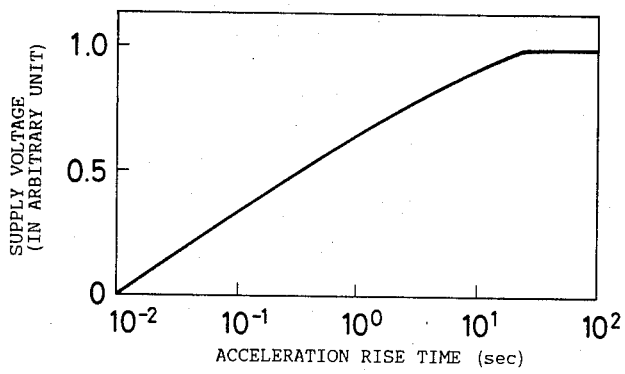
FIG. 7 presents graphs plotting the relationship between the acceleration rising time and the intensity of the magnetic field of the focusing magnet when the present stabilizing method is used.
Figure 7:
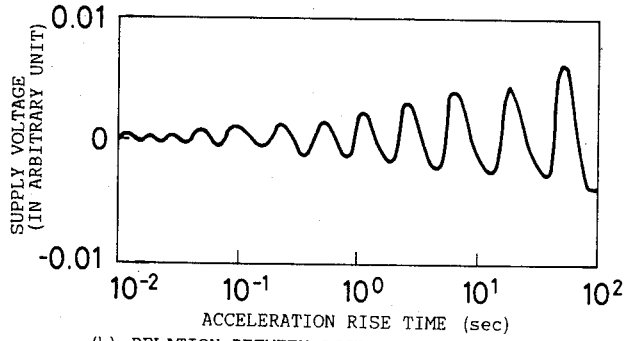
Figure 7:
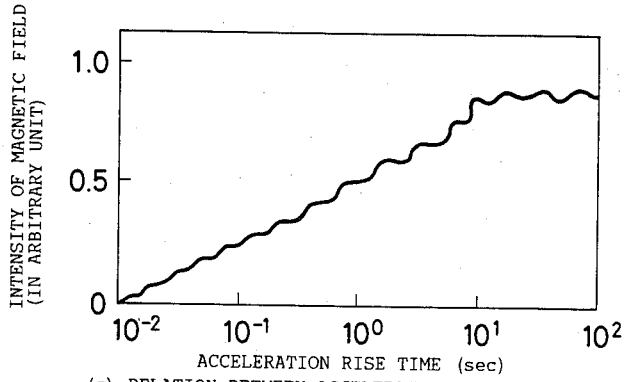

It takes several seconds for the bending magnets to raise the intensity of the magnetic field to the final value for the superconductive magnets. Ten seconds is required for 4T if the rising rate of the magnetic field is 0.4T/sec. At this time, the focusing magnets are also associated, as shown in FIG. 7(*c*), with the bending magnets to increase the intensity of the magnetic field. FIG. 6 schematically shows the power source of the focusing magnets. This power sources is composed of a main power source 200 and an auxiliary power source 210 for superposing a sinusoidal voltage. The voltage of the main power source exhibits the rise shown in FIG. 7(*a*). The auxiliary power source exhibits the voltage change shown in FIG. 7(*b*). As a result, the magnetic field intensity of the focusing magnets changes, as shown in FIG. 7(*c*).

By the method described above, the storage ring is accelerated from a low energy to a predetermined high energy, and the intensity of the bending magnets is then held at 4T with the intensity of the focusing magnets being held constant.

Next, the instability to be established in the electron storage ring will be described in the following to qualitatively evaluate the effectiveness of the present invention.

One cause conceivable for the instability is the interactions between the radio-frequency cavity and the vacuum chamber. This instability is composed of a longitudinal one, in which oscillations occur in the proceeding direction of the electron beam, and a transverse one in which oscillations occur perpendicularly to the proceeding direction. Of these, the longitudinal instability is suppressed by the Landau damping due to the distorsion of the radio frequency bucket even if it grows to some extent so that it is reluctant to lead to the beam loss. Therefore, the transverse instability will be noted.

Figure 8:
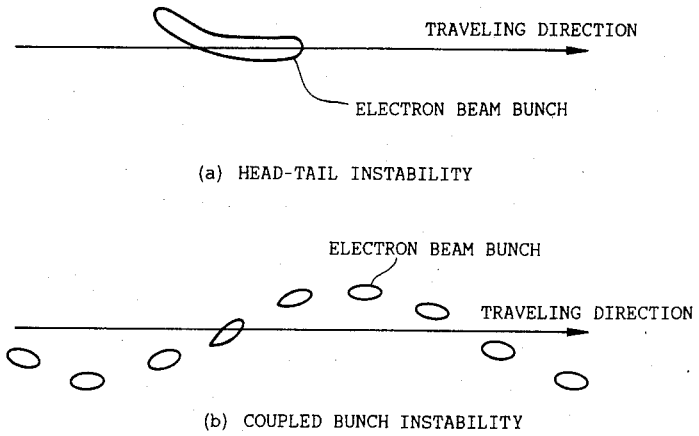
FIG. 8 is a an electron beam diagram showing the behaviors of a bunch when the beam becomes unstable.

This transverse instability is also classified into two kinds. The first one is called the "head-tail instability", in which, by the electrons at the tail of the bunch are deflected by the electromagnetic field caused by the electrons at the head of the bunch. The second one is called the "coupled bunch instability", in which, by the electromagnetic field established by the preceding bunch, the succeeding bunch is deflected as a whole, which in turn exerts a force the succeeding bunch so that the train of bunches oscillate as a whole in the form of waves. FIG. 8 schematically shows the behaviors of the bunch when the two instabilities occur.

In the first head-tail instability, by the electromagnetic field established by the leading electrons through the vacuum chamber and the bellows, the trail electrons receive a force, which will attenuate before long to exert no influence upon the succeeding bunch. This instability is characterized in that it has little relationship with the betatron frequency but in that its vibration range is very wide. This instability raises no serious problem because it can be completely suppressed by changing the chromatic aberration to zero or a positive value. Especially, in the case of the electron beam, moreover, the head-tail instability is also thought to raise no serious problem because the bunch length is not so large as that of a proton beam, e.g., several cms for several hundreds MeV.

The second coupled bunch instability is caused mainly by the parasitic resonance mode of the radio-frequency acceleration cavity. Naturally, the electromagnetic field established by the electron beam is reluctant to attenuate soon, because the high Q value of the cavity, so that the succeeding bunches are sequentially exposed to the influences of the electromagnetic field established by the preceding bunches. This phenomenon will occur even for one bunch number in a small-sized ring having a small circumference. This instability is characterized in that a resonance occurs in a certain frequency. On principle, therefore, the resonance could be avoided by shifting the betatron frequency. As a matter of fact, incidentally, the instability cannot be completely avoided because of the numerous resonance frequencies and the resonance width other than zero. Therefore, only the coupled bunch instability will be considered in the following. In this case, moreover, the oscillation mode to be considered may be restricted to the dipole mode which will change dipolarly.

At this time, the growth time of the coupled bunch instability is designated at $\tau_1$, this time $\tau_1$ is proportional to the energy but inversely proportional to the current. If a constant of proportion is designated at $C_1$, the time $\tau_1$ is expressed by the following equation (1):

$$\tau_1 = C_1 E / I_0 \quad (1),$$

wherein:

E: Electron energy; and $I_0$: Storage current value.

What is effective to suppress the coupled bunch instability is limited to the damping effect due to the radiation damping. If the damping time due to this radiation damping is designated at $\tau_2$, this time $\tau_2$ is expressed by the following equation (2):

$$\tau_2 = C_2 / E^3 \quad (2),$$

wherein $C_2$: Constant.

The threshold current without nothing done takes a value when the times $\tau_1$ and $\tau_2$ match, and the following equation (3) is obtained for $\tau_1 = \tau_2$:

$$I_0 = \frac{C_1}{C_2} E^4 \quad (3)$$

Since the threshold current value is made proportional to the fourth power of the energy for the suppression of the radiation damping only by the equation (3), it is found that the smaller current can be held for the lower energy. The limit current value is increased by the adiabatic damping effect in the synchrotron having a normal rising rate as high as several tens msecs, the rising rate of the present storage ring becomes as long as ten secs so that the adiabatic damping effect cannot be expected.

If the damping time according to the present system is designated at $\tau_3$, the damping time $\tau_4$ according to the radiation damping and the present system are expressed by the following equation (4):

$$\tau_4 = \frac{\tau_2 \tau_3}{\tau_2 + \tau_3}. \quad (4)$$

The threshold current value in this case is expressed by the following equation (5) for $\tau_1=\tau_4$:

$$\frac{C_1E}{I}=\frac{\tau_2\tau_3}{\tau_2+\tau_3}$$

that is to say, $$I=\frac{(\tau_2+\tau_3)C_1E}{\tau_2\tau_3}=\frac{C_1E}{\tau_2}+\frac{C_1E}{\tau_3} \quad (5)$$

Here, the first term implies the threshold current value due to the radiation damping effect only, and the second term implies the increment according to the present system. Hence, the equation (5) can be rewritten in the following form:

$$I=I_0+\Delta I_0 \quad (6).$$

Hence, the increasing ratio of the threshold current according to the present system is expressed by the following equation (7):

$$\frac{I}{I_0}=1+\frac{\Delta I_0}{I_0}. \quad (7)$$

The equation (1) is written in more detail in the form of the following equation (8):

$$\tau_1=\frac{(1+m)2\nu\omega_0\gamma m_0 2\pi RB\Sigma h_m(\omega)}{eBZ_1I_0h_m(\omega_{re})}; \quad (8)$$

and $$B=\frac{ML}{2\pi R}, \quad (9)$$

wherein:

m: Number of integer of nodes of bunches;
$\nu$: Betatron frequency per circulation (Tune);
$\omega_0$: Angular frequency;
$\gamma$ Ratio of energy to electron mass;
$m_0$: Electron mass;
R: Average radius of storage ring;
$\beta$: Quotient of electron velocity by velocity of light;
e: Electron charge;
$Z_1$: Coupling impedance;
$h_m$: Power spectrum of unstable beam;
M: Number of bunches;
L: Length of bunches; and
$\omega_{re}$: Angular frequency for resonance.

Here, m=0 because nothing but the mode of m=0 is observed in the normal synchrotron and storage ring. Moreover, it is difficult to accurately calculate the coupling impedance $Z_1$ indicating the intensity of the parasitic resonance mode of the cavity. Hence, the impedance $Z_1$ takes 1 MΩ, considering the cavity impedances of the various storage rings.

The equation (8) is written in more detail into the following equation (10):

$$\tau_2=2ET/J_\epsilon U_{rad} \quad (10)$$

wherein:

T: Circulation time:
$J_\epsilon$: Damping partition number; and
$U_{rad}$: Energy loss due to radiation.

The energy loss $U_{rad}$ is proportional to the fourth power of the energy so that the time $\tau_2$ is proportional to $E^{-3}$.

The damping time according to the present system is expressed by the following equation (11):

$$\tau_3=1/2\pi\Delta\nu f_r \quad (11),$$

wherein:

$\Delta_r$: Movement of tune; and
$f_r$: Revolution frequency.

Here, the movement $\Delta_r$ is expressed by the following equation (12):

$$\Delta\nu=\frac{1}{4\pi}\int k\beta ds, \quad (12)$$

wherein:

k: Sinusoidally varying component of focusing magnets; and
$\beta$: Betatron function.

Here, it is assumed that the component k vary in the following equation (13):

$$k=k_0(t)\sin 2\pi ft \quad (13)$$

From the equation (13), the average changing rate of the component k is expressed by the following equation (14):

$$<k>=\sqrt{2}\,\pi f k_0(t). \quad (14)$$

Hence, the change of the rate <k> for the time Δt is expressed by the following equation (15):

$$<k>\Delta t=\sqrt{2}\,\pi f k_0(t)\Delta t. \quad (15)$$

If the time for one circulation of the bunches is taken as Δt, the equation (15) is rewritten into the following equation (16) because Δt=L/C:

$$<k>\Delta t=\sqrt{2}\,\pi f k_0(t)L/C. \quad (16)$$

wherein:

L. Circumference of storage ring; and
C: Velocity of light.

From the equations (16) and (12), the following equation (17) is obtained:

$$\Delta\nu=2\pi f_0k_0(t)\frac{L}{C}\,\frac{\int\beta ds}{4\pi}. \quad (17)$$

Substitution of the equation (17) into the equation (11) deduces the following equation (18):

$$\tau_3=\frac{\sqrt{2}\,C}{\pi f f_r k_0(t)L\int\beta ds}=\frac{C_3}{fk_0(t)}. \quad (18)$$

In other words, the damping time according to the present system is inversely proportional to the frequency of the sinusoidally varying focusing force and the vibrations of the sinusoidal waves. The value $k_0$ is the better if its intensity is the higher. However, the storage ring has a number of resonance lines caused by the errors in the magnetic field, and the tune is lost if it crosses the resonance lines. For the excessively high value $k_0$, the tune crosses the resonance lines so that the electrons are lost. If the maximum shift of the tune is suppressed within 0.005, it is appropriate that the value $k_0$ be held at about 1/100 as high as the intensity of the focusing magnets. At this time, the value $k_0$ is expressed by the following equation (19):

$$k_0=0.01\times K/l_Q \quad (19),$$

wherein:

K: Focusing power of focusing magnets; and $l_Q$: Length of focusing magnets.

Since the focusing magnets of the present storage ring has an intensity of $K_1=1.23$ ($m^{-1}$) and a length of $l_Q=0.3$ m, the value $k_0$ is expressed by the following equation (20):

$$k_0=0.041\ (m^{-2}) \quad (20).$$

Figure 9:
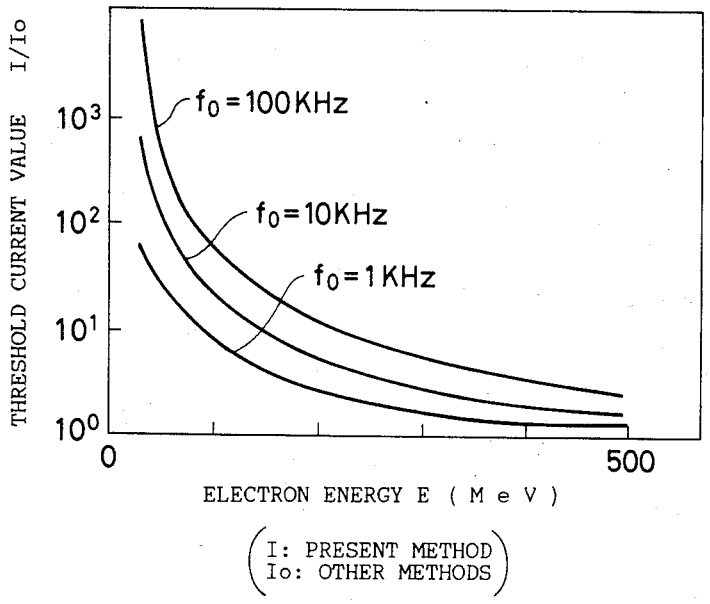
FIG. 9 presents a graph showing the relationships between the threshold current value and the electron energy when the present stabilizing method is executed.

The increasing rate of the threshold current according to the present method is plotted in FIG. 9 by using the equations (5), (7), (8), (10), (11) and (18) and the parameters of the storage ring tabulated in the Table 1.

In the present method, the sinusoidally varying voltage is superposed on the focusing magnets, but these focusing magnets may be replaced by focusing magnets which have sinusoidally varying components only.

Since a new damping effect is obtained in addition to the damping effect due to the radiation damping, according to the present invention, it is possible to drastically raise the threshold current value at which the instability of the storage electrons takes place. This threshold current value rises several times at most for the electron energy of 500 MeV but several hundreds times for the lower energy of 15 MeV. This makes it possible to store a high current without any loss of electrons even for the acceleration from the low energy. As a result, there arises an effect that the pre-accelerator may be small-sized to reduce the size of and simplify the system.

What is claimed is:

1. An electron beam stabilizing method for suppressing the instability of an electron beam in an electron storage ring comprising the steps of:

(1) superimposing a voltage component fluctuating with time on a power supply of a focusing magnet of said ring;

(2) fluctuating the intensity of said focusing magnet to change the betatron frequency of said electron beam.

2. An electron beam stabilizing method as set forth in claim 1, characterized in that the voltage to be superposed on the power source of said focusing magnet is sinusoidal.

3. In an electron storage ring comprising: a bending magnet for bending an electron beam; a focusing magnet for focusing the electron beam; a radio-frequency accelerating cavity for accelerating electrons; and a vacuum chamber;

an electron storage ring system characterized in that means for supplying the intensity of the magnetic field of the focusing magnet is constructed of a power source system including: a power supply for increasing the intensity of the magnetic field of the focusing magnet while holding a ratio of the intensity of the magnetic field of the focusing magnet to the intensity of the magnetic field of the bending magnet constant; and a power source for providing a voltage component fluctuating with time.

4. An electron storage ring system as set forth in claim 3, wherein said power source providing a voltage component fluctuating with time superimposes the fluctuating voltage component on said power supply of said focusing magnet thereby fluctuating the intensity of said focusing magnet to change the betatron frequency of the electron beam.

5. An electron storage ring system as set forth in claim 4, wherein said power source provides a sinusoidal voltage component fluctuating with time.

* * * * *